US005472739A

United States Patent [19]

Kubota et al.

[11] Patent Number: 5,472,739

[45] Date of Patent: Dec. 5, 1995

[54] PROCESS OF PRODUCING A HOT DIPPED WIRE FROM A BASE WIRE, WITH THE ABSENCE OF IRON-BASED, IRON OXIDE-BASED AND IRON HYDROXIDE-BASED MINUTE PARTICLES ON SURFACES OF THE BASE WIRE

[75] Inventors: Misao Kubota; Yoshitada Hanai; Kouichi Otani, all of Nagano, Japan

[73] Assignee: Totoku Electric Co., Ltd., Tokyo, Japan

[21] Appl. No.: 760,295

[22] Filed: Sep. 16, 1991

[30] Foreign Application Priority Data

Sep. 20, 1990 [JP] Japan ..... 2-252853

[51] Int. Cl.[6] ..... B05D 3/02

[52] U.S. Cl. ..... 427/319; 427/329; 427/433

[58] Field of Search ..... 427/432, 433, 427/436, 319, 329, 434.6

[56] References Cited

U.S. PATENT DOCUMENTS

| | | | |
|---|---|---|---|
| 3,692,578 | 9/1972 | Schreiner et al. | 427/319 |
| 3,782,909 | 1/1974 | Cleary et al. | 427/329 |
| 3,808,033 | 4/1974 | Mayhew | 427/433 |
| 4,053,663 | 10/1977 | Caldwell et al. | 427/432 |
| 4,143,184 | 3/1979 | Paulus et al. | 427/329 |

FOREIGN PATENT DOCUMENTS

| | | |
|---|---|---|
| 0246418 | 11/1987 | European Pat. Off. . |
| 59-129759 | 7/1984 | Japan . |
| 59-143057 | 8/1984 | Japan . |

OTHER PUBLICATIONS

02–222505, Japan, Maejima et al., (abstract only), Sep. 5, 1990.

"Patent Abstracts of Japan", unexamined application, C field, vol. 8, No. 273, Dec. 13, 1984, The Patent Office Japanese Government, p. 7 C 256, * Kokai—No. 59–143 057 * + Abstract +.

"Patent Abstracts of Japan", unexamined applications, C field, vol. 8, No. 251, Nov. 16, 1984, The Patent Office Japanese Government, p. 79 C 252, * Kokai—No. 59–129 759 * + Abstract +.

"High Speed Vacuum Tinning Plant 'VSA' (Inert Atmosphere)", *Niehoff Machines–Systems–KnowHow,* Niehoff Gruppe Griller & Co. (no date).

*Primary Examiner*—Shrive Beck
*Assistant Examiner*—Katherine A. Bareford
*Attorney, Agent, or Firm*—Jordan and Hamburg

[57] ABSTRACT

A process of producing a hot dipped wire. During the wire drawing, the base wire is passed over a passage surface made of a non-iron material. After steam heating, cleaning and drying steps, the wire is heated in an atmosphere of a reducing gas for effectively removing an oxide layer on the surface of the wire and for preheating the wire to accelerate a reaction between the wire and a molten hot dipping metal used in the subsequent hot dipping step.

5 Claims, 4 Drawing Sheets

(a)

(b)

PROCESS OF PRODUCING A HOT DIPPED WIRE FROM A BASE WIRE, WITH THE ABSENCE OF IRON-BASED, IRON OXIDE-BASED AND IRON HYDROXIDE-BASED MINUTE PARTICLES ON SURFACES OF THE BASE WIRE

BACKGROUND OF THE INVENTION

1. Field of the Invention

The present invention relates to a process of producing a hot dipped wire which is suitably used as a lead of an electronic component and a conductor of an electronic wiring, and more particularly but not exclusively relates to a process of fabricating a hot dipped tinned wire and a hot dipped solder plated wire.

2. Prior Art

A typical attempt of the conventional processes of producing hot dipped wires is illustrated in FIG. 5, in which a base wire to be plated undergoes wire drawing to produce a predetermine diameter wire 1' to be plated usually in a water soluble lubricant or an oil lubricant, using a wire drawing machine (not shown) including shoulder rollers, pulleys, a capstan, etc, all of which have wire passage surfaces made of iron materials. The drawn wire 1' to be plated is wound over a spool 2'. In the next step, the wire 1' to be plated which is unwound from the spool 2' is pulled through a steam annealing furnace 3' for annealing, and is then cleaned during traveling through a cleaning bath 5' using water 4'. Subsequently, the wire 1' to be plated is dried by heating in the dryer 6 to remove moisture on it, is passed through an acid flux bath 11 for acid cleaning the surface thereof, and is finally directly introduced with the acid flux adhering to it into a hot dipping metal bath 8, where the wire 1' to be plated makes contact with the molten metal for plating as well as cleaning the surface thereof. Then, the wire 1' to be plated passes through a drawing die d to produce a hot dipped wire 1'*a*.

Heretofore, iron materials were commonly used in shoulder rollers, pulleys, the capstan, etc of the wire drawing machine which define the wire drawing passage. For this reason, in the wire drawing step a trace amount of iron powder adheres to the surface of the wire 1' to be plated, which is then wound around a spool 2' with the iron powder adhered thereto. Furthermore, an iron spool is used for the spool 2' Thus, the wire 1' to be plated is placed into contact with iron materials of the spool for a long period of time during storage as well as during the wire drawing step.

Particularly, during the storage in the iron spool, the wire 1' to be plated comes into contact with the iron materials of the body and the flange of the spool, and hence it is inevitable that iron oxides, such as an iron rust, adhere to the surface of the wire 1' to be plated. Such iron oxides provide very adverse influences in quality on the plated wire during the following hot dipping step. More specifically, the iron oxides adhering to the surface of the wire 1' to be plated change to iron hydroxides during travel in the steam annealing furnace 3' of the plating pretreatment step. When the wire 1' to be plated is introduced into the hot dipping bath 8, the iron hydroxides are decomposed to produce water, which is vaporized at once and dissipated from the surface of the wire 1' to be plated. As a result, nonplated portions are produced at surface portions of the wire 1' where the iron hydroxides had been adhered, and exposed surface portions are thus produced in the hot dipped wire.

Moreover, since the acid flux bath 11 is used in the plating pretreatment step, the acid is likely to scatter, and the acid flux adhered to the wire 1' to be plated is vaporized in the hot dipping bath 8 which is kept at a high temperature. These phenomena are liable to deteriorate or damage the equipment, and to pollute the working environment. Furthermore, the acid flux produces a metallic salt by reacting with the molten metal of the hot dipping bath, resulting in degradation of the hot dipping bath. Thus, the plating is deteriorated in quality.

SUMMARY OF THE INVENTION

Accordingly, it is an object of the present invention to provide a process of producing a hot dipped wire, which process is capable of producing a hot dipped wire having an excellent excellent in quality without exposed portions of the core wire.

It is another object of the present invention to provide a process of producing a hot dipped wire, which process is capable of reducing damages to the equipment, pollution of the working environment, and degradation of the plating.

In view of this and other objects, one aspect of the present invention is directed to a process of producing a hot dipped wire, comprising the steps of: wire drawing a base wire in a water soluble lubricant, using a wire drawing machine having a passage surface made of a material not generating iron oxide; during the wire drawing, passing the base wire over the passage surface; winding the drawn wire around a spool having a surface made of a material not generating iron oxide; during the winding step, bringing the drawn wire in contact with the surface; pretreating the wire unwound from the spool, the pretreating step including: steam heating the wire unwound in an atmosphere of steam for facilitating separation of the lubricant from the wire and for annealing; and cleaning the wire steam heated for cleaning the lubricant from the wire; drying the cleaned wire; and reducing gas heating the dried wire in an atmosphere of a reducing gas for effectively removing an oxide layer on the surface of the dried wire and for preheating the dried wire to accelerate a reaction between the wire and a molten hot dipping metal used in a subsequent step; and then, hot dipping the oxide layer removed wire in the molten hot dipping metal, the hot dipping step being directly connected to the reducing gas heating step.

According to another aspect of the present invention, there is provided a process of producing a hot dipped wire, comprising the steps of: wire drawing a base wire in a water soluble lubricant, using a wire drawing machine having a passage surface made of a material not generating iron oxide; during the wire drawing, passing the base wire over the passage surface; pretreating the drawn wire from the wire drawing step, the pretreating step including: steam heating the drawn wire in an atmosphere of steam for facilitating separation of the lubricant from the wire and for annealing; and cleaning the wire steam heated for cleaning the lubricant from the wire; drying the cleaned wire; and reducing gas heating the dried wire in an atmosphere of a reducing gas for effectively removing an oxide layer on the surface of the dried wire and for preheating the dried wire to accelerate a reaction between the wire and a molten hot dipping metal used in a subsequent step; and then, hot dipping the oxide layer removed wire in the molten hot dipping metal, the hot dipping step being directly connected to the reducing gas heating step.

DETAILED DESCRIPTION OF THE PREFERRED EMBODIMENTS

Several modes of this invention will be described hereinafter with reference to the accompanying drawings, but some of the description thereof is simplified or omitted since the steps of the present invention are similar to those of the prior art in many points except both the reducing gas heating step and the use of materials not generating iron oxide in the wire passages. Conventional techniques relating to the present invention are disclosed in Japanese Patent Application Laying-Open Nos. sho59-129759, sho59-143057 and the Pamphlet issued by NIEHOFF (German company), for instance, which disclosures are incorporated herein by reference.

Figure 1:
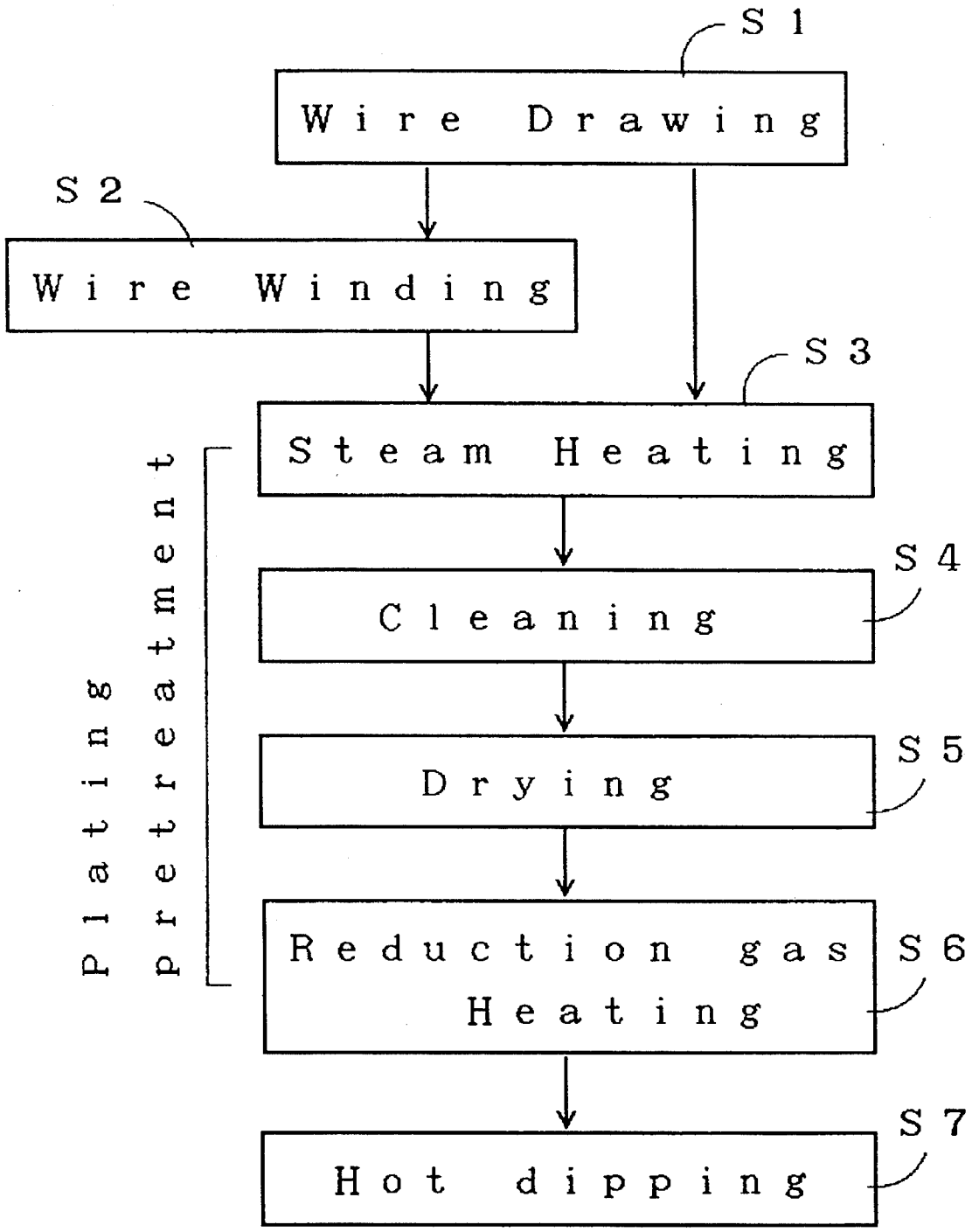
FIG. 1 is a block diagram showing two aspects of a process of producing a hot dipped wire according to the present invention.
Figure 2:
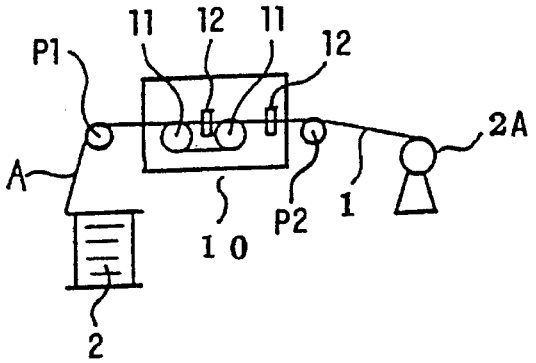
FIG. 2(*a*) and FIG.2(*b*) are diagrammatic illustrations of a wire drawing step, and plating pretreatment and hot dipping steps according to the present invention, respectively.
Figure 2:
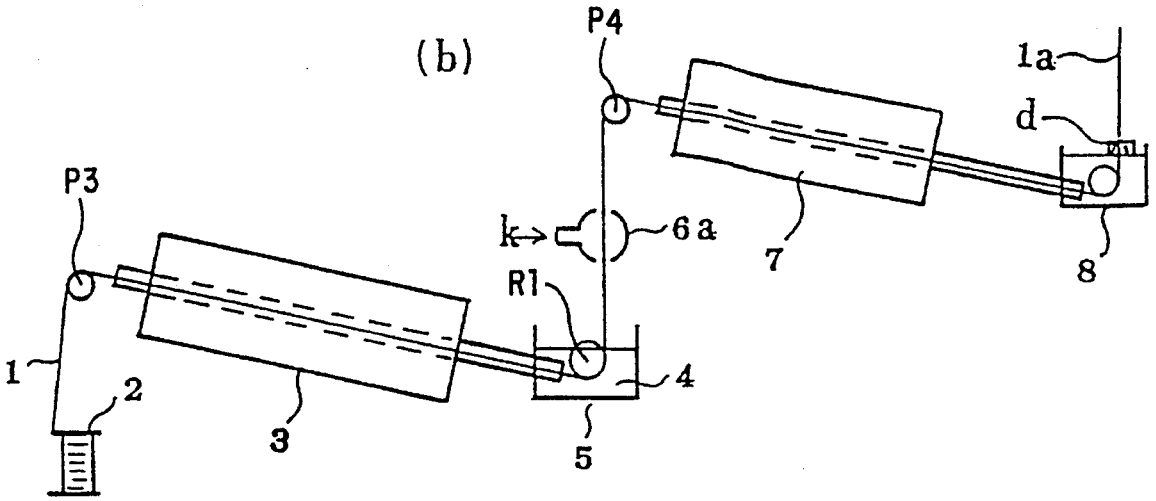

According to the present invention, as shown by the reference numeral S1 in FIG. 1 and in FIG.2, a base wire A such as a copper wire, is drawn in a water soluble lubricant ("LUBLITE #2000 " 4.5% conc. NIHON YUZAI KENKYUSHO/Japanese company or "METALSYN N-321 " 6% conc. KYOEISHA YUSHI KAGAKU KOGYO/Japanese company ) into a predetermined diameter, using a wire drawing machine 10 shown in FIG. 2(*a*) including, for example, shoulder rollers step rolls 11, a dice 12, pulleys and a capstan all of which were coated with a ceramic for contact with the base wire.

As shown by the reference numeral S2 in FIG. 1 and in FIG. 2(*a*), the wire 1 thus drawn may be from a spool 2*a and* wound around a spool 2 which surfaces are coated with a plastic ( for example, epoxy resin ) for contact with the wire 1, and may be then stored with its surface free of any iron powder and any iron oxide adhered to it.

After the wire winding step S2, as indicated by the reference numeral S3 in FIG. 1 and in FIG. 2(*b*), the wire 1 to be plated is pulled at a speed of about 50 to 90 m/min, typically 70 m/min, and is directly introduced into a tunnel furnace 3, for example 2 m long, in the atmosphere of a steam at about 650° C., for example.

Figure 3:
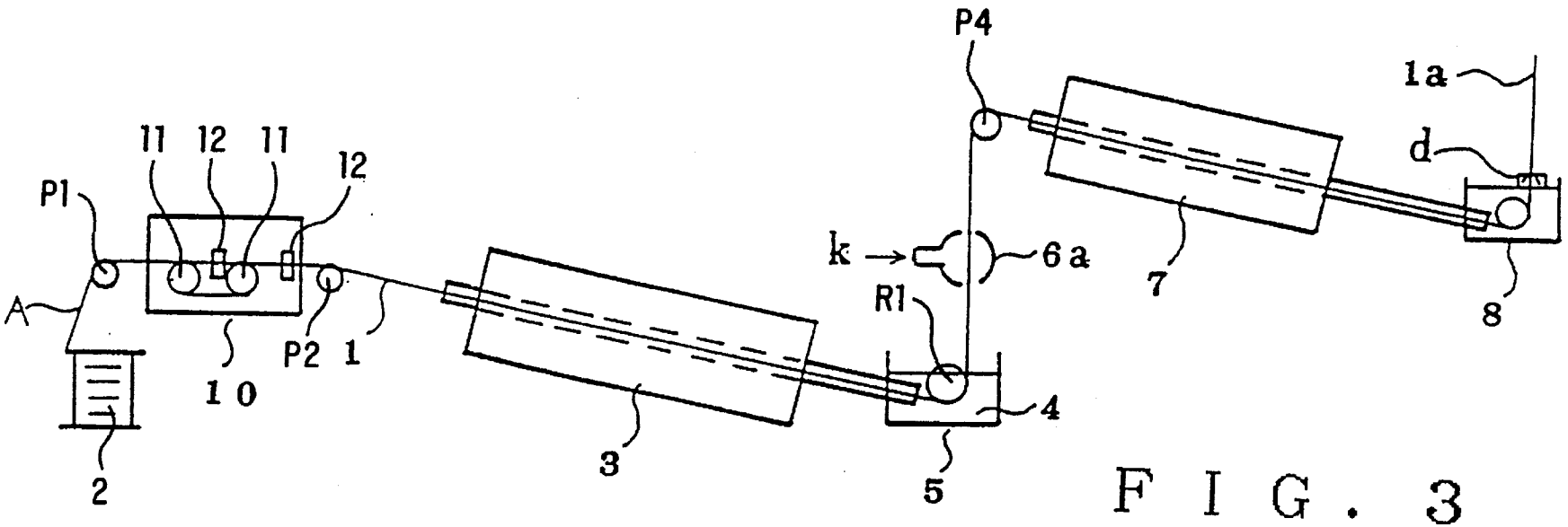
FIG. 3 is a diagrammatic illustration of another aspect of the present invention.

Alternatively, after the wire drawing step S1, the wire 1 is, as shown in FIG. 3, unwound from the spool 2A, and is fed to the tunnel furnace 3 under the same conditions.

In the furnace 3, the wire 1 to be plated is cleaned with steam so that the water soluble lubricant can be easily separated from the surface of the wire 1. The steam enters the furnace 3 from a source of boiling water by itself without applying any additional pressure, that is, at a pressure slightly higher than the atmospheric pressure. Simultaneously, the wire 1 was annealed in the furnace 3.

Thereafter, as indicated by the reference numeral S4 in FIG. 1 and in FIG. 2(*b*), without exposing to the atmosphere the wire 1 is introduced into a cleaning bath, for example, an ultrasonic cleaning bath 5, containing pure water 4 and a turn roll R1, in which the wire 1 is completely cleaned off to remove the water soluble lubricant and other adhering impurities from its surface.

Subsequently, as indicated by the reference numeral S5 in FIG. 1 and in FIG. 2(*b*), moisture was removed of the wire 1 by a dryer, such as an air wiper 6a into which compressed air k was introduced, so that the wire 1 is dried.

Then, as indicated by the reference numeral S6 in FIG. 1 and in FIG. 2(*b*), the wire 1 is introduced into a gas reducing furnace 7, about 1 to 3 m long, typically 2 m long, in an atmosphere of a reducing gas, such as a carbon monoxide gas and nitrogen gas, at a set temperature of typically about 300 to 500° C., so that the oxidized layer on the surface of the wire 1 may be reduced. Simultaneously, the wire 1 is preheated in the gas reducing furnace 7.

In such a state, as indicated by the reference numeral S7 in FIG. 1 and in FIG. 2(*b*), the wire 1 is introduced into a hot dipping bath 8, such as a tinning bath and a soldering bath, where a molten metal is adhered to the wire 1, which is then passed through a drawing die d, provided just above the hot dipping bath 8 for drawing the molten metal adhering to the wire 1 so as to provide a molten metallic plating with a predetermined thickness over the wire 1. Then, the wire 1 is introduced into the atmosphere to cool and solidify the plating layer, so that a hot dipped wire 1*a* is fabricated.

The surfaces, on which the wire passes, including pulleys P1–P4 from the wire drawing step S1 to the hot dipping step S7 may be protected by a material not generating iron oxide, for example a conventional non-iron material such as a ceramic and a plastic. As a result, the copper wire 1 is hot dipped with little impurities adhered and little oxidized layer, and thus a hot dipped tinned wire 1*a* having excellent quality may be fabricated without any exposed core surface.

EXAMPLE 1

A copper base wire A with a diameter 2.6 mm, as illustrated in FIG. 2(*a*), was drawn in a water soluble lubricant into a 0.3 mm diameter copper 1 wire to be plated, using a wire drawing machine 10 including shoulder rollers, pulleys and a capstan all of which were coated with a ceramic for contact with the base wire. The copper wire 1 thus drawn was wound around a spool 2 which surfaces were coated with a plastic for contact with the wire, and was thus stored with its circumferential surface free of any iron powder and any iron oxide adhered to it. Then, as shown in FIG. 2(*b*), the copper wire 1 to be plated was unwound from the spool 2 at a speed of 70 m/min, and was pulled through a 2 m long tunnel furnace 3 in the atmosphere of a steam at 650° C. In the furnace 3, the copper wire 1 to be plated was cleaned with steam so that a trace amount of the water soluble lubricant could be easily separated from the surface of the wire 1. Simultaneously, the wire 1 was annealed. Thereafter, without exposing to the atmosphere the wire 1 was introduced into an ultrasonic cleaning bath 5, containing pure water 4, in which the wire 1 was completely cleaned off to remove the water soluble lubricant and other adhering impurities from its surface. Subsequently, moisture was removed from the wire 1 by an air wiper 6*a* into which compressed air k was introduced, so that the wire 1 was dried. Then, the wire 1 was introduced into a gas reducing furnace 2 m long with a carbon monoxide atmosphere at a highest temperature of 500° C., so that the oxidized layer on the surface of the wire 1 was reduced, and was thereby removed as $CO_2$ gas. The temperature of the furnace 7 was 300° C. at each of the inlet and outlet thereof. Simultaneously, the wire 1 was preheated. In such a state, the wire 1 was introduced into a hot dipping tinning bath 8, where a molten tin was adhered to the wire 1, which was then passed through a drawing die d, provided just above the hot dipping bath 8 for drawing the molten tin adhering to the wire 1 so as provide about a 5 μm thick molten tin plating over the wire 1. Then, the wire 1 was introduced into the atmosphere to cool and solidify the plating layer, so that a hot dipped tinned wire 1*a* was fabricated. The surfaces, on which the wire passed, from the wire drawing step to the hop dipping step were coated with a non-iron material such as a ceramic and a plastic. As a result, the copper wire 1 was hot dipped with little impurities adhered and little oxidized layer, and thus a hot dipped tinned wire 1*a* having excellent quality was fabricated without any exposed core surface.

EXAMPLE 2

As illustrated in FIG. 3, wire drawing step S1, plating pretreatment S3 to S6 and hot dipping step S7 were conducted in a continuous line.

According to the same conditions as in the wire drawing step of Example 1, a 2.6 mm diameter copper base wire A to be plated was drawn by the same wire drawing machine as in Example 1 into a 0.3 mm diameter copper wire 1, which was continuously introduced into the tunnel furnace 3 used in Example 1 without having been wound around a spool. The subsequent steps were conducted in the same conditions as in Example 1, and thereby a hot dipped tinned wire 1*a* was produced. Also in this example, the wire 1 was pulled at a speed of 70 m/min. The surfaces, on which the wire passed, from the wire drawing step to the hop dipping step were also coated with a non-iron material such as a ceramic and a plastic. The hot dipped tinned wire 1*a* fabricated in Example 2 also had an excellent appearance without any exposed core wire surface.

EXAMPLE 3

Figure 4:
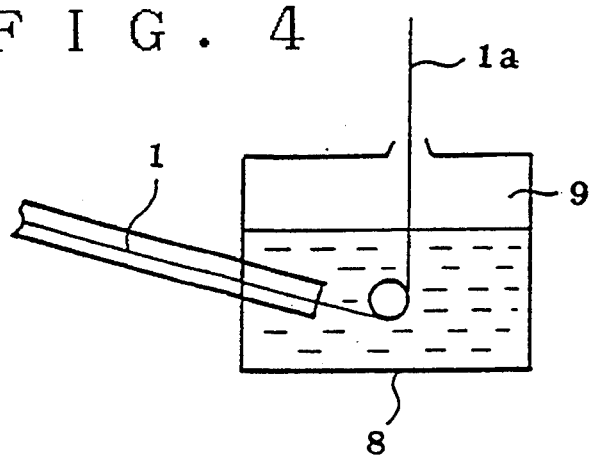
FIG. 4 is a diagrammatic illustration of a modified form of the hot dipping bath of FIG. 3.
Figure 5:
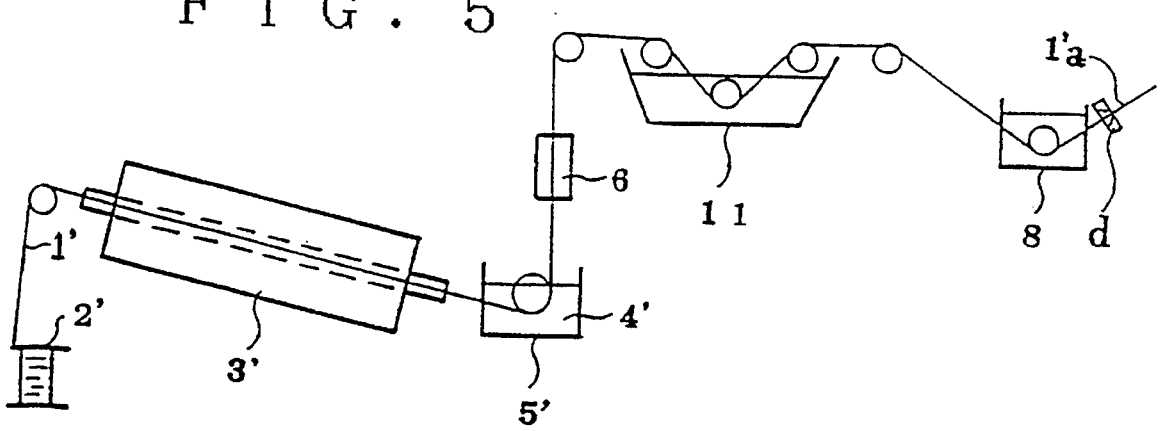
FIG. 5 is a diagrammatic illustration of the conventional process of producing a hot dipped wire.

As shown in FIG. 3 and FIG. 4, wire drawing step S1, plating pretreatment S3 to S6 and hot dipping step S7 were conducted in a continuous line as in Example 2 although no drawing die d was used in the hot dipping step S7.

As a base wire A to be plated a 2.6 mm diameter oxygen free copper (OFHC) wire was used, and was drawn into a 0.46 mm diameter OFHC wire 1 according to the same conditions as in the wire drawing step using the same wire drawing machine 10 of Example 1. Then, without having been wound on a spool the OFHC wire 1 was continuously passed through the furnace 3, the ultrasonic cleaning bath 5 and the air wiper 6*a* in the same conditions as in Example 1. Then, the OFHC wire 1 was pulled to pass through a 2 m long gas reducing furnace 7 in the atmosphere of a nitrogen gas containing 10 volume % of hydrogen gas at a set temperature of 500° C., so that the oxygen layer on the wire 1 is removed by reduction with the wire 1 preheated. The OFHC wire preheated was, as shown in FIG. 4, introduced into a hot dipping bath 8 at a set temperature 260° C. After dipped in the molten tin, the OFHC wire 1 was drawn out vertically upwardly, so that the OFHC wire 1 was tinned without using any drawing die. In this event, the OFHC wire 1 vertically passed through a CO containing non-oxidizing atmosphere chamber 9 which was disposed to contact the level of the molten tin. This uniformly controlled the thickness of the plating adhered to the OFHC 1, and then the wire 1 was introduced into the atmosphere to cool and solidify the plating layer. The hot dipped tinned wire 1*a* thus produced had a 12 μm thick plating. In this example, the wire 1 was pulled at a speed of 30 m/min. Also, in this example, the surfaces, on which the wire 1 passed, from the wire drawing step S1 to the hot dipping step S7 were coated with a non-iron material such as a ceramic and a plastic as in Example 1.

The hot dipped wire 1*a* had an excellent appearance without any exposed core wire and with a uniform plating.

What is claimed is:

1. A process of producing hot dipped wire, comprising the steps of:

wire drawing a base wire, said base wire made of a material selected from the group consisting of copper and copper alloy, in a water soluble lubricant by means of a wire drawing machine to obtain a wire to be plated;

winding the wire to be plated around a spool;

pretreating the wire to be plated, the step of pretreating including the steps of:

steam heating the wire to be plated, cleaning the wire to be plated, drying the wire to be plated, and heating the dried wire to be plated in an atmosphere of a reducing gas;

hot dipping the wire to be plated with a molten material selected from the group consisting of tin and tin-alloy, and wherein the improvement comprises the step of:

providing a passage along which the base wire and the wire to be plated is passed, in all of the steps before the hot dipping step, so as to inhibit physical deposition of iron-based, iron oxide-based and iron hydroxide-based minute particles on surfaces of the base wire and the wire to be plated and on surfaces of the passage contacted by the base wire and the wire to be plated.

2. A process according to claim 1, wherein said passage surfaces include a spool over which the base wire is wound, a spool over which the wire to be plated is wound, a turn roll of a cleaner, an internal wall of a dryer, an internal wall of a heating furnace, and guide pulleys.

3. A process according to claim 1, wherein said passage surfaces are made of a material selected from the group consisting of ceramic and resin.

4. A process of producing hot dipped wire, comprising the steps of:

wire drawing a base wire, said base wire made of a material selected from the group consisting of copper and copper alloy, in a water soluble lubricant by means of a wire drawing machine to obtain a wire to be plated;

pretreating the wire to be plated, the step of pretreating including the steps of:

steam heating the wire to be plated, cleaning the wire to be plated, drying the wire to be plated, heating the dried wire to be plated in an atmosphere of a reducing gas, and continuously guiding and running the wire to be plated from said wire drawing step along a passage in said steam heating, cleaning, drying and heating steps; and hot dipping the wire to be plated with a molten material selected from the group consisting of tin and tin-alloy, wherein the improvement comprises the step of:

providing said passage along which the base wire and the wire to be plated are passed, in all of the steps before the hot dipping step, so as to inhibit physical deposition of iron-based, iron oxide-based and iron hydroxide-based minute particles on surfaces of the base wire and the wire to be plated and on surfaces of the passage contacted by the base wire and the wire to be plated.

5. A process according to claim 4, wherein said passage surfaces are made of a material selected from the group consisting of ceramic and resin.

* * * * *